US006476305B2

(12) United States Patent
Yamauchi

(10) Patent No.: US 6,476,305 B2
(45) Date of Patent: Nov. 5, 2002

(54) METHOD AND APPARATUS FOR MODIFYING MUSICAL PERFORMANCE DATA

(75) Inventor: Akira Yamauchi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/816,878

(22) Filed: Mar. 23, 2001

(65) Prior Publication Data

US 2002/0007724 A1 Jan. 24, 2002

(30) Foreign Application Priority Data

Mar. 24, 2000 (JP) ..... 2000-084448

(51) Int. Cl.[7] ..... G10H 1/22; G10H 1/26

(52) U.S. Cl. ..... 84/609; 84/618; 84/649; 84/656; 84/DIG. 2

(58) Field of Search ..... 84/618, 656, 684, 84/DIG. 2, 609–614, 634–638, 649–652, 666–669

(56) References Cited

U.S. PATENT DOCUMENTS

| | | | | | |
|---|---|---|---|---|---|
| 4,213,366 | A | * | 7/1980 | Niimi et al. | 84/618 X |
| 4,402,245 | A | * | 9/1983 | Oya et al. | 84/618 X |
| 5,095,800 | A | * | 3/1992 | Matsuda | 84/618 |
| 5,229,533 | A | * | 7/1993 | Sakurai | 84/618 |
| 5,410,099 | A | * | 4/1995 | Kosugi | 84/618 |
| 5,686,682 | A | * | 11/1997 | Ohshima et al. | 84/618 X |
| 5,703,310 | A | * | 12/1997 | Kurakake et al. | 84/618 X |
| 5,959,232 | A | * | 9/1999 | Wakuda | 84/618 |

* cited by examiner

*Primary Examiner*—Stanley J. Witkowski
(74) *Attorney, Agent, or Firm*—Morrison & Foerster LLP

(57) ABSTRACT

A data modifying apparatus having: a memory that stores modification data for modifying data; a detecting unit for detecting each data group from performance data, the data group being unable to be reproduced at the same time from the viewpoint of music; and a modifying unit for modifying the data group detected by the detecting unit to divide the data group into a plurality of sub-data groups capable of being reproduced at the same time from the viewpoint of music, by using the modification data.

13 Claims, 8 Drawing Sheets

FIG. 5

| TONE PROPERTY EVENT | | 41 | |
|---|---|---|---|
| NUMBER OF TONES OF CHORD | | 4 | |
| NOTE EVENT | TIMING | TONE VALUE DATA | TONE REPRODUCTION LENGTH DATA |
| A | $t_2=t_1$ | $v_2=0.25v_1$ | $l_2=0.25v_1$ |
| B | $t_2=t_1$ | $v_2=0.25v_1$ | $l_2=0.25v_1$ |
| C | $t_2=0.25v_1+t_1$ | $v_2=0.75v_1$ | $l_2=0.75l_1$ |
| D | $t_2=0.25v_1+t_1$ | $v_2=0.75v_1$ | $l_2=0.75l_1$ |

FIG. 7A
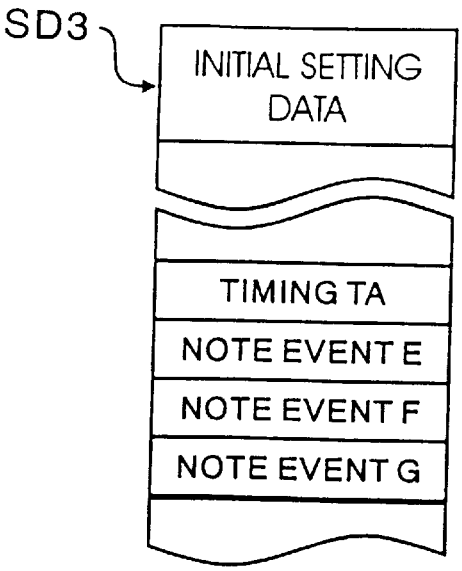
FIG. 7B
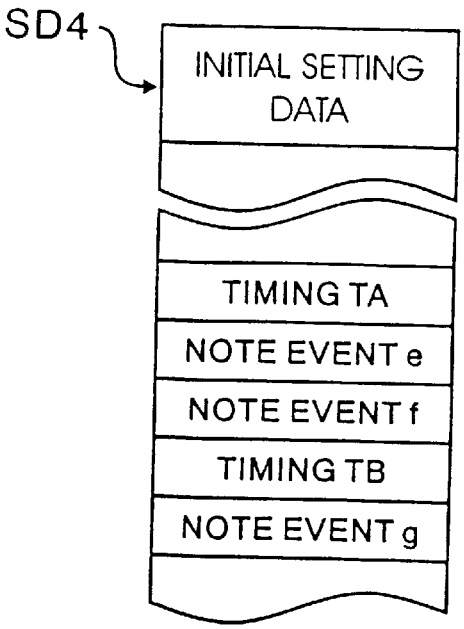
FIG. 8
| TONE PROPERTY EVENT | | 41 | |
|---|---|---|---|
| NUMBER OF TONES OF CHORD | | 3 | |
| NOTE EVENT | TIMING | TONE VALUE DATA | TONE REPRODUCTION LENGTH DATA |
| E | $t_2=t_1$ | $v_2=0.25v_1$ | $l_2=0.25v_1$ |
| F | $t_2=t_1$ | $v_2=v_1$ | $l_2=l_1$ |
| G | $t_2=0.25v_1+t_1$ | $v_2=0.75v_1$ | $l_2=0.75l_1$ |

METHOD AND APPARATUS FOR MODIFYING MUSICAL PERFORMANCE DATA

This application is based on Japanese Patent Application 2000-084448, filed on Mar. 24, 2000, the entire contents of which are incorporated herein by reference.

BACKGROUND OF THE INVENTION a) Field of the Invention

The present invention relates to a data modifying apparatus, and more particularly to a data modifying apparatus capable of modifying musical performance data.

b) Description of the Related Art

FIG. 9 is a diagram showing the format of performance data.

Performance data SD is automatic performance data of one musical program, and is constituted of performance data of tracks 1 to n each including initial setting data. If the performance data SD is written in the standard MIDI file format, the initial setting data and real performance data are expressed in the MIDI data format. The performance data SD (MIDI data) has timing data for the reproduction of each note and note events each including pitch data of each musical tone, tone value data, tone reproduction length data and the like. The performance data SD also has setting data for setting performance environments such as tone properties and effects for a series of consecutive musical tones.

The initial setting data is often positioned at the top of the performance data SD. The initial setting data is preset for playing the musical program. For example, the initial setting data includes a tone property event, rhythm data and the like at the start of automatic performance, as well as a tone volume and effects.

Each track can be roughly classified into the initial setting data and following real performance data. The real performance data is performance data (parameters) other than the initial setting data, for example, data continuing immediately after a timing TA at the start of a musical program.

Three methods "musical score notation", "numerical value notation" and "piano roll notation" are well known as a MIDI data notation methods. MIDI data can be modified by using these methods.

With the musical score notation, MIDI data is represented by a musical score form. In modifying MIDI data, notes and signatures are placed on a staff notation, and the position of each note or signature is changed or each note or signature is deleted, for example, by using a mouse.

Musical score data is used for musical score notation of real performance data. As the musical score data, data for displaying tune, rhythm and the like on the staff, data for identifying real performance data corresponding to the displayed musical score data, and other data are stored. After these data, position data corresponding to timing data of the real performance data for displaying notes and signatures corresponding to an event at each timing is stored.

In this specification, the "performance data" is intended to mean automatic performance data including musical score data. If musical score data corresponding to performance data does not exist, the performance data (automatic performance data) contains only the performance data without musical score data.

With the numerical value notation, all MIDI data are represented by numerical values stored in a table. In modifying MIDI data, numerical values at corresponding table positions are changed or deleted, or new numerical values are entered in the table at corresponding positions.

With the piano roll notation, the length of each tone and its reproduction timing are represented by a bar graph.

For automatic performance, initial setting data is first read to initialize tone property and the like, and then real performance data is read synchronously with timings T to play the program by reproducing sounds and stopping sounds.

For example, for the automatic performance of the performance data SD shown in FIG. 9, the initial setting data is first read to initialize the tone property corresponding to the tone property event in the initial setting information. Then, data such as rhythm data and the like is read. It is assumed that the tone property set by the tone property event of the performance data SD is for violin. Because of the structure of violin, some chords cannot be played with violin.

Next, at a timing TA, note events A, B, C and D are read at the same time. Namely, although an instruction to reproduce a chord of four tones is issued, a violin cannot play this chord. Therefore, if the performance data SD shown in FIG. 9 is played, an unnatural performance is made which cannot be actually played with a violin.

SUMMARY OF THE INVENTION

It is an object of the present invention to provide a data modifying apparatus capable of automatically modifying performance data so as to make the performance data match the performance of a natural musical instrument and provide a storage medium storing a performance data modifying program.

According to one aspect of the present invention, there is provided a data modifying apparatus comprising: a memory that stores modification data for modifying data; a detector that detects each data group from performance data, the data group being unable to be reproduced at the same time from a viewpoint of music; and a modifying device that modifies the data group detected by the detector to divide the data group into a plurality of sub-data groups capable of being reproduced at the same time from a viewpoint of music, by using the modification data.

According to another aspect of the invention, there is provided a data modifying apparatus comprising: a detector that detects a portion of performance data played with a predetermined tone property, a plurality of sounds in the portion being reproduced at the same reproduction timing; and a modifying device that modifies modifying a reproduction timing of some of the plurality of sounds in the portion detected by the detector.

According to the invention, performance data can be modified automatically so as to make the performance data match the performance of a natural musical instrument.

BRIEF DESCRIPTION OF THE DRAWINGS

FIG. 5 is a data modifying table.

FIGS 7A and 7B are diagrams showing the formats of performance data.

FIG. 8 is a data modifying table.

DETAILED DESCRIPTION OF THE PREFERRED EMBODIMENTS

Figure 1:
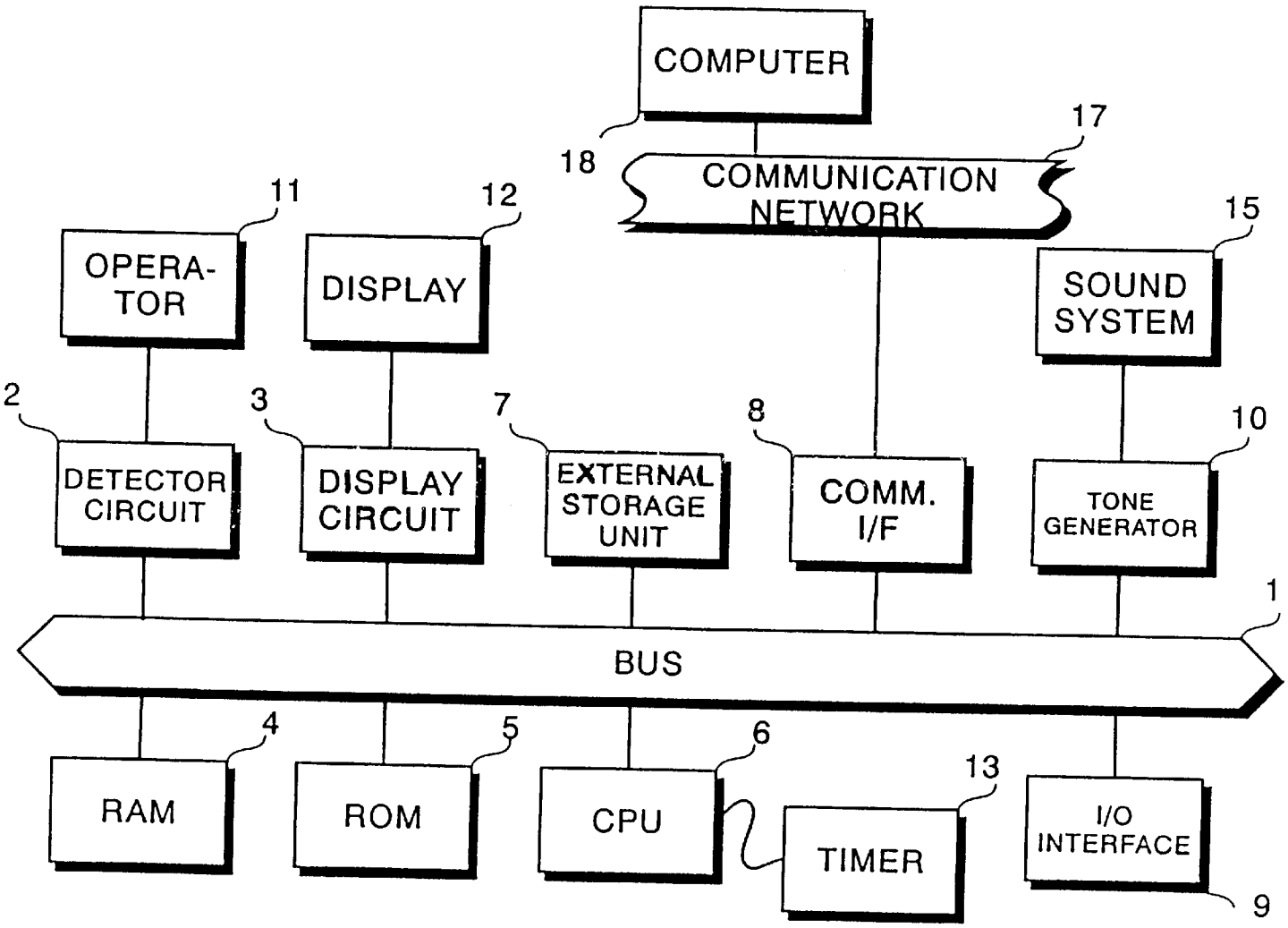
FIG. 1 is a block diagram showing a specific hardware structure of a data modifying apparatus.

FIG. 1 is a block diagram showing the fundamental structure of hardware of an electronic musical instrument or general purpose computer PC having a data modifying apparatus according to an embodiment of the invention. In this specification, since the description is directed mainly to modification of musical performance data, the data modifying apparatus is called hereinafter a performance data modifying apparatus.

The performance data modifying apparatus has a bus 1, a detector circuit 2, a display circuit 3, a RAM 4, a ROM 5, a CPU 6, an external storage unit 7, a communication interface 8, an I/O interface 9, a tone signal generator circuit 10, an operator 11, a display 12, a timer 13, and a sound system 15. External devices of the performance data modifying apparatus may be used for the operator 11, display 12, and sound system 15.

The bus 1 is connected to the detector circuit 2, display circuit 3, RAM 4, ROM 5, CPU 6, external storage unit 7, communication interface 8, I/O interface 9, timer 13 and tone signal generator circuit 10.

A user can instruct to modify data such as performance data by using the operator 11 connected to the detector circuit 2. The operator 11 may be any device capable of outputting a signal corresponding to a user input, such as a mouse, a keyboard, an electronic musical instrument keyboard, a joy stick, and switches. A plurality of input means or operators 11 may be connected to the apparatus.

The display circuit 3 is connected to the display 12 which can display performance data before and after modification.

An image displayed on the display 12 may be a musical score notation of musical score data, performance data notation (numerical value notation, piano roll or the like) of performance data, and the like. Switches or the like to be used by a user for entering various instructions for performance data modification may also be displayed. A plurality of windows may be displayed when necessary.

The external storage unit 7 has an interface with the bus 1. The external storage unit 7 may be a floppy disc drive (FDD), a hard disc drive (HDD), a magneto optical (MO) drive, a compact disc—read-only memory (CD-ROM) drive, a digital versatile disc (DVD) drive or the like. The external storage device 7 can store various data such as performance data and musical score data, a data modifying program of this embodiment, and the like.

RAM 4 has a working area of CPU 6 for storing flags, registers, buffers, MIDI performance data and the like. ROM 5 stores various parameters, control programs, data modifying programs of this embodiment, and the like. The programs are not required to be duplicately stored in the external storage apparatus 7. CPU 6 performs calculations and controls in accordance with the control program and the like stored in ROM 5 or in the external storage unit 7.

The timer 13 is connected to the bus 1 and CPU 6 and supplies a master clock signal, an interrupt timing, and the like to CPU 6.

Performance data before modification is stored in the external storage unit 7, RAM 4 or ROM 5. Performance data after modification is written in the rewritable external storage unit 7 or RAM 4. The performance data before or after modification may be transferred to and from the external circuit via the I/O interface 9 or communication interface 8.

The I/O interface 9 is used for the connection to other electronic musical instruments, acoustic instruments, computers or the like and can transmit and receive at least MIDI signals. The I/O interface 9 may be a MIDI interface, a USB (universal serial bus) interface, an IEEE1394 interface or the like.

The tone signal generator circuit 10 generates tone signals corresponding to supplied MIDI signals or the like and supplies the tone signals to the sound system 15. The sound system 15 includes a D/A converter and a speaker, converts digital tone signals into analog tone signals to reproduce sounds.

The tone signal generator circuit 10 may be any type such as a waveform memory type, an FM type, a physical model type, a harmonics synthesis type, a formant synthesis type, and an analog synthesizer type of VCO (Voltage Controlled Oscillator)+VCF (Voltage Controlled Filer)+VCA (Voltage Controlled Amplifier).

The tone signal generator circuit 10 is not limited only to a dedicated hardware structure, but may be a structure of a DSP (Digital Signal Processor)+microprograms, a structure of a CPU+software programs, or an audio card.

A plurality of sound reproduction channels may be formed by time-divisionally using one tone signal generator circuit, or a plurality of sound reproduction channels may be formed by using a plurality of tone signal generator circuits, one tone signal generator circuit per one sound reproduction channel.

The control program, performance data or the like may be stored in a hard disc of the external storage unit 7. By reading the control program or the like from the hard disc to RAM 4, CPU can perform an operation similar to that when the control program or the like is stored in ROM 5. In this case, addition, version-up or the like of the control programs or the like can be performed easily.

The control program, performance data or the like may be stored in a CD-ROM. The control program, performance data or the like can be copied from CD-ROM to the hard disc. New installation and version-up of the control programs or the like can be performed easily.

The communication interface 8 is connectable to the communication network 17 such as a LAN (local area network), the Internet, and a telephone line. By connecting to the computer 18 via the communication network 17, control programs, performance data or the like can be downloaded from the computer 18 to the external storage unit 7 such as HDD, RAM 4 or the like.

The performance data modifying apparatus as a client transmits a command of requesting to download control programs, performance data or the like to the computer 18 via the communication interface 8 and communication network 17. Upon reception of this command, the computer 18 distributes the requested control programs, performance data or the like to the performance data modifying apparatus via the communication network 17. The performance data modifying apparatus receives the control program, performance data or the like via the communication interface 8, and stores it in the external storage unit 7 or RAM 4 to thereby complete download.

Figure 2:
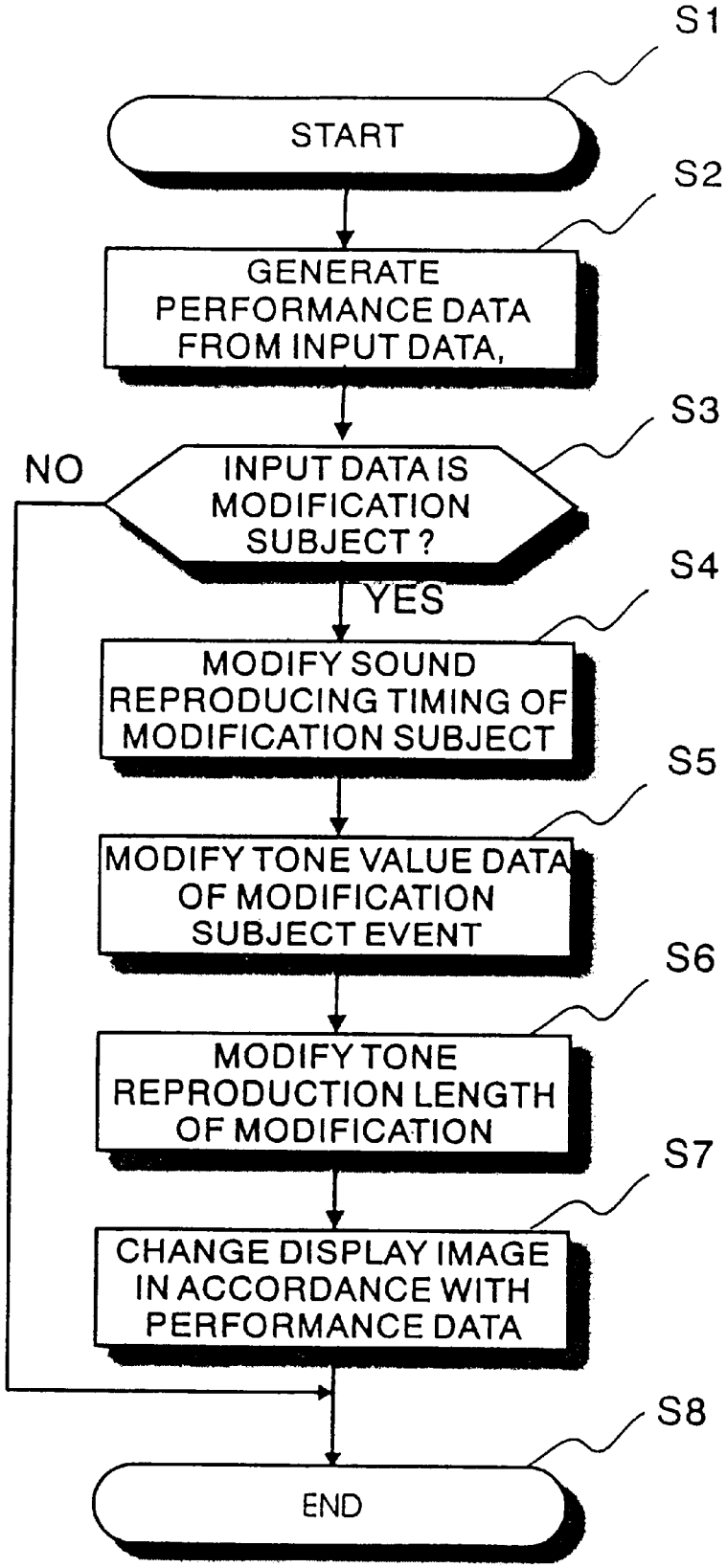
FIG. 2 is a flow chart illustrating a main process to be executed by a CPU.

The process to be executed by CPU 6 will be described. FIG. 2 is a flow chart illustrating a main process to be executed by CPU 6.

At Step S1 a data modifying process starts automatically in response to new information input or manually in response to a user instruction. Thereafter, the flow advances to next Step S2.

At Step S2, performance data is generated in accordance with input information. Musical score data for musical score notation may be generated from generated performance data. The format of the performance data and score data is, for example, a format shown in FIG. 4A or 7A to be described later. The format includes at least timing data for the reproduction of each note, and a note event including tone pitch data, tone value data, tone reproduction length data and the like of each tone. In this embodiment, a music program of generated performance data can be reproduced in accordance with an automatic performance program (conventional techniques) not shown in the drawings.

At Step S3 it is judged whether the input performance data is to be modified or not. For this judgement, a data modifying table (modified data table) such as shown in FIG. 5 or 8 to be later described is used. At this Step S3, the judgement is made at two stages, one for a tone property judgement and the other for a chord judgement.

First, the property of a tone in the input performance data (note events) to be reproduced is detected by referring to the tone property event in the setting data in the performance data. If the value of the tone property even is coincident with the value of a tone property event in the data modifying table, the chord judgement process is performed. If not coincident, it is judged that the input performance data is not modified at this timing, and the flow advances to Step S8 as indicated by a NO arrow.

At the chord judgement process, the number of tones in the input performance data to be reproduced at the same time at this timing is detected by checking the number of note events in the performance data at the same timing. If there are three note events at the same timing, it can know that these note events are a chord of three tones. Similarly, if there are four note events at the same timing, it can know that these note events are a chord of four tones.

Next, it is checked whether the number of detected tones of a chord is coincident with that of a chord in any one of the data modifying tables having the same value of the tone property event. If there is such a data modifying table, it is judged that the input data is modification subject data, and the flow advances to next Step S4 as indicated by a YES arrow, whereas if there is no such a data modifying table, it is judged that the input data is not modification subject data to thereby skip to Step S8 as indicated by a NO arrow. The table having the same number of detected tones of a chord is used for data modification at Steps S4 to S6.

In this embodiment, each time a new note event is input, a data modifying process is executed. Instead, the performance data stored beforehand in ROM, RAM or external storage unit may be read to detect modification subject data. The performance data may be downloaded via the communication network and communication interface.

At Step S4, the sound reproducing timing of each note event of the chord judged to be modified is modified. The sound reproducing timing is modified by using the data modifying table. Thereafter, the flow advances to Step S5.

At Step S5, the tone value data of each note event of the chord judged to be modified is modified. The tone value data is modified by using the data modifying table. Thereafter, the flow advances to Step S6.

At Step S6, the tone reproduction length of each note event of the chord judged to be modified is modified. The tone reproduction length is modified by using the data modifying table. Thereafter, the flow advances to Step S7.

At Step S7, the displayed image on the display is changed in accordance with the performance data after modification. For example, the left side score shown in FIG. 3B to be described later is changed to the right side score. This display image change may not be performed. Alternatively, a user instruction may be used for switching between displaying the image change or not displaying the image change. Thereafter, the flow advances to Step S8 whereat the data modifying process is terminated.

The data modifying process of this embodiment will be described more specifically by taking as an example a chord of four tones. It is assumed that the tone property event is set to violin.

Figure 3A:
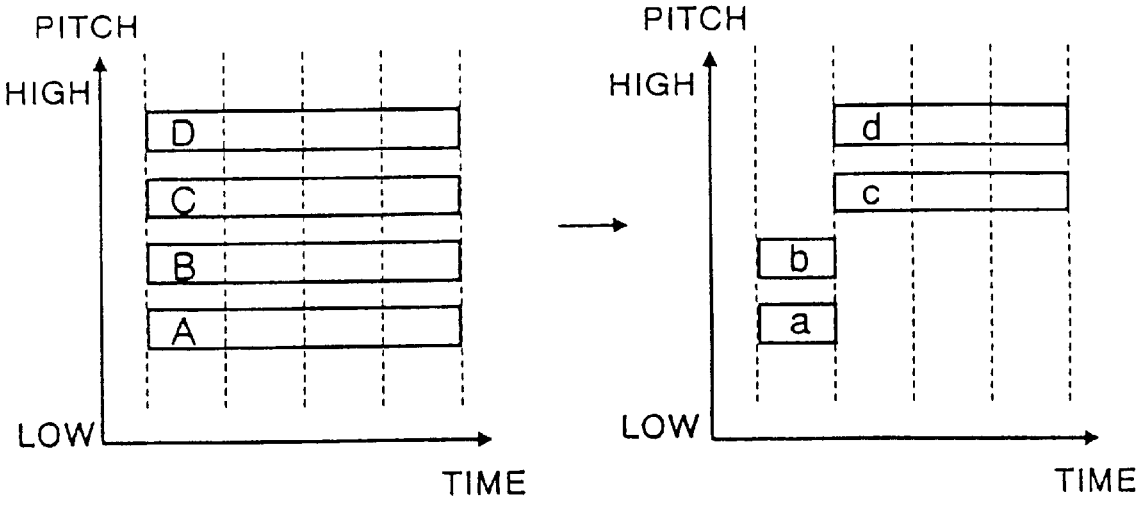
FIGS. 3A and 3B are diagrams showing examples of images displayed on a screen.
Figure 3B:
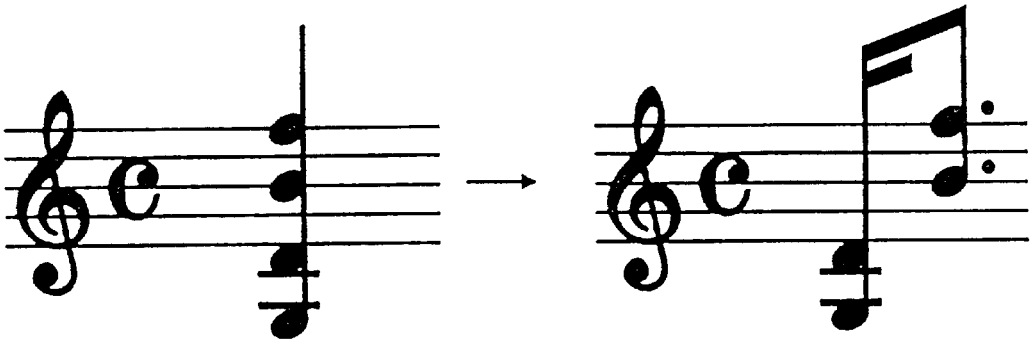

FIGS. 3A and 3B show an example of displayed images before (left side) and after (right side) modification of performance data when a chord of four notes is input. FIG. 3A shows piano roll notation, and FIG. 3B shows a musical score notation. In FIGS. 3A and 3B, although only the portion of performance data to be modified is displayed, the whole of one musical program may be displayed. In this case, it is preferable to highlight the portion to be modified, in order to notify the user of a modified portion.

This score shown on the left side of FIG. 3B cannot be played with a violin because the structure of the violin does not permit to play four strings at the same time. The number of strings capable of being played at the same time is normally two so that the score shown on the left side is required to be played as the score shown on the right side of FIG. 3B.

Therefore, when performance information corresponding to the left side score shown in FIG. 3A is input, it is necessary to change the performance data generated from the input performance information to the performance data corresponding to the right side score shown in FIG. 3B.

Figure 4A:
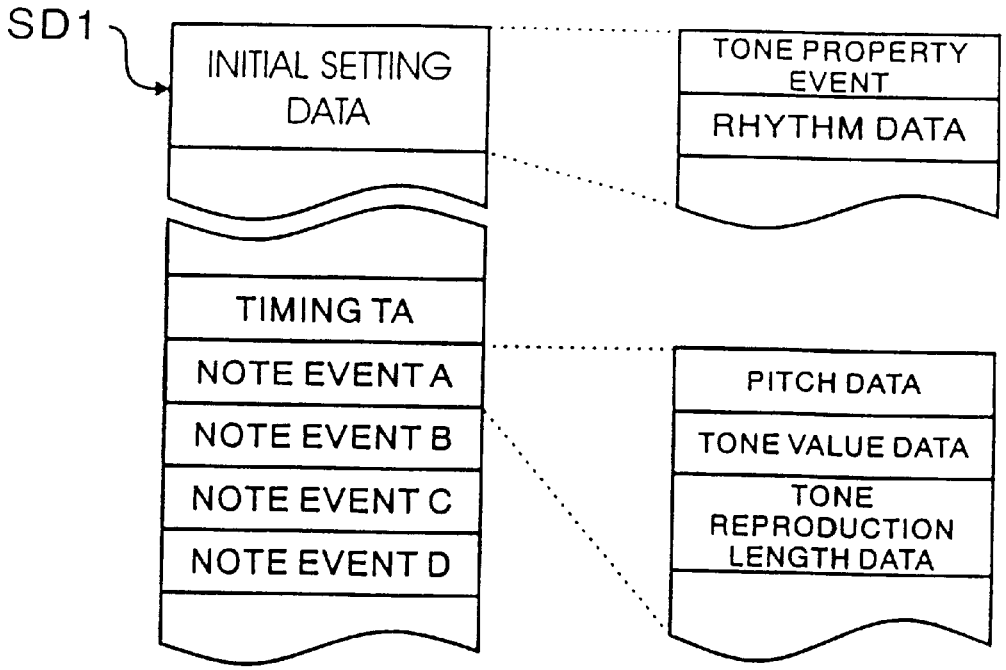
FIGS. 4A and 4B are diagrams showing the formats of performance data.
Figure 4B:
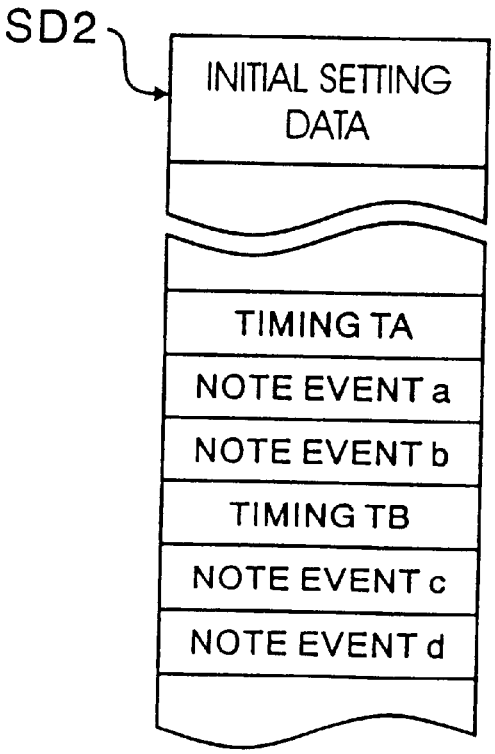

FIGS. 4A and 4B are diagrams showing the formats of performance data. FIG. 4A shows performance data SD1 containing a chord of four tones before modification stored in the standard MIDI file format. The left side images in FIGS. 3A and 3B are displayed in accordance with the performance data SD1 before modification or score data generated therefrom.

The performance data SD1 has timing data TA for the reproduction of each tone and note events A to D each including pitch data of each musical tone, tone value data, tone reproduction length data and the like. The performance data SD1 also has a parameter setting event for setting performance environments such as tone properties and effects for a series of consecutive musical tones.

Initial setting data is positioned at the start of the performance data SD1. For example, the initial setting data includes a tone property event, rhythm data and the like at the start of automatic performance.

The timing data TA may use a lapsed time from the event one event before the present event or an absolute time in a musical program or measure, as an occurrence time of a performance event.

FIG. 5 shows an example of the data modifying table which stores modified data for a chord of four tones. The data modifying table stores a tone property event to be modified and the number of tones of a chord (the number of tones to be reproduced at the same time), and in addition, a modifying method for timing data, tone value and tone reproduction length of each note event and modified values.

In this example, a value "41" is stored as the tone property event to be modified. The tone property event "41" represents the tone property for a violin, usually in this field of the art. The value of the tone property event is not limited only to a numerical value, but it may be a tone property name such as "violin". Since a chord unable to be reproduced changes from one musical instrument to another, it is preferable to prepare the table for each tone property event. However, a plurality of tone property events to be modified may be stored in one table.

A value "4" is stored as the number of tones of a chord to be modified. It can therefore be understood that the table shown in FIG. 5 is applied to the tone property of violin and the chord of four tones. In FIG. 5, the note events A to D stand for a lowest sound A, a lower sound B, a higher sound C and a highest sound D.

After the performance data SD1 shown in FIG. 4A is judged to be modified at Step S3 shown in FIG. 2, the following modification is made by referring to the table shown in FIG. 5. For the lowest sound (note event A) and lower sound (note event B) in the chord, the sound reproduction timing t2 after modification is set to the same value as the sound reproduction timing t1 before modification (t2=t1). The tone value (v2) after modification is set to a value of the tone value (v1) before modification multiplied by 0.25 (v2=0.25 v1). The tone reproduction length (l2) after modification is set to the same value (l2=0.25 v1) as the tone value (v2) after modification, by multiplying the tone value (v1) before modification by 0.25. After these modifications, the modified data is stored as tone events a and b. The reason for setting the tone reproduction length after modification as the same value as the tone value after modification, is to give slur effects.

An actual violin may reproduce three tones at an instant or four tones are reproduced in a spatial acoustic field. Therefore, a period of reproducing three or four tones at the same time may be provided. In this case, it is preferable to modify the value of the tone reproduction length rather than the tone value. More specifically, the tone reproduction length of the lowest sound or lowest and lower sounds are set longer than the tone value.

For the higher sound (note event C) and highest sound (note event D) in the chord, the sound reproduction timing t2 after modification is set to the value (0.25 v1+t1) which is an addition of the sound reproduction timing t1 before modification and a tone value (v1) before modification multiplied by 0.25 (0.25 v1). This modification is made so as to delay the sound reproduction timing after modification by a quarter of the tone value before modification. Namely, in order not to reproduce two tones at the same time, the timing is modified relative to the two tones on the lower sound side.

The tone value (v2) after modification is set to a value of the tone value (v1) before modification multiplied by 0.75 (v2=0.75 v1). The tone reproduction length (l2) after modification is set to the same value (l2=0.75 v1) as the tone value (v2) after modification, by multiplying the tone value (v1) before modification by 0.75. After these modifications, the modified data is stored as tone events c and d.

FIG. 4B is a diagram showing performance data SD2 after the performance data SD1 shown in FIG. 4A is modified by using the contents in the data modifying table shown in FIG. 5. It can be understood from FIG. 4B that a timing TB is newly inserted to delay the timing of the note events C and D and reproduce the tone events c and d at the timing TB. It can also be understood that the tone events A and B are changed to the tone events a and b. In accordance with the modified performance data SD2 or the score data generated from the modified performance data SD2, the display images are changed to the images on the right side of FIGS. 3A and 3B.

With the method described above, even if performance information containing a chord of four tones unable to be reproduced by violin at the same time is input, the timing T of two tones can be automatically delayed for automatic performance. According to the embodiment, an unnatural portion of performance data actually unable to be played can be changed to performance data which a natural musical instrument can play.

The data modifying process of this embodiment will be described more specifically by taking as an example a chord of three tones. It is assumed that the tone property event is set to violin.

Figure 6A:
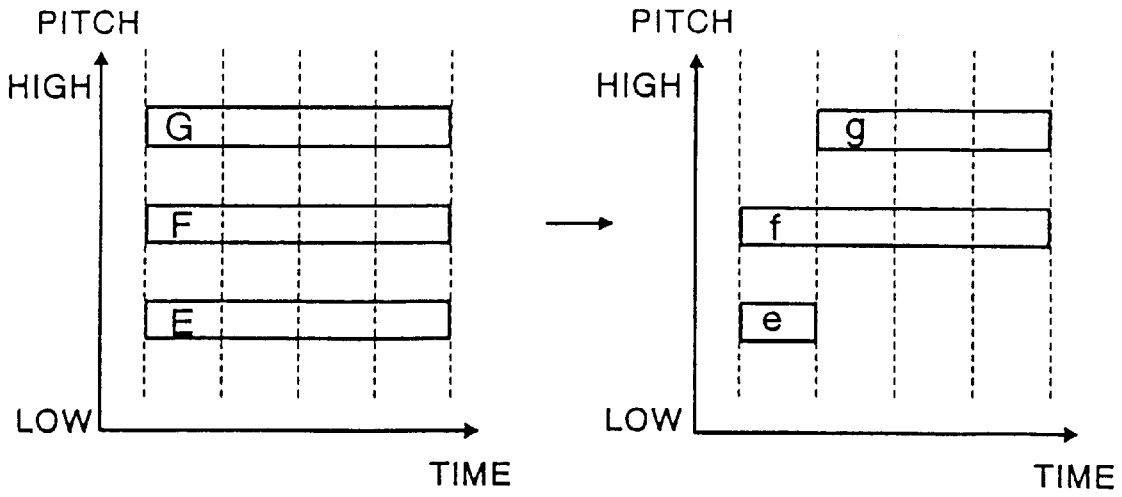
FIGS. 6A and 6B are diagrams showing examples of images displayed on a screen.
Figure 6B:
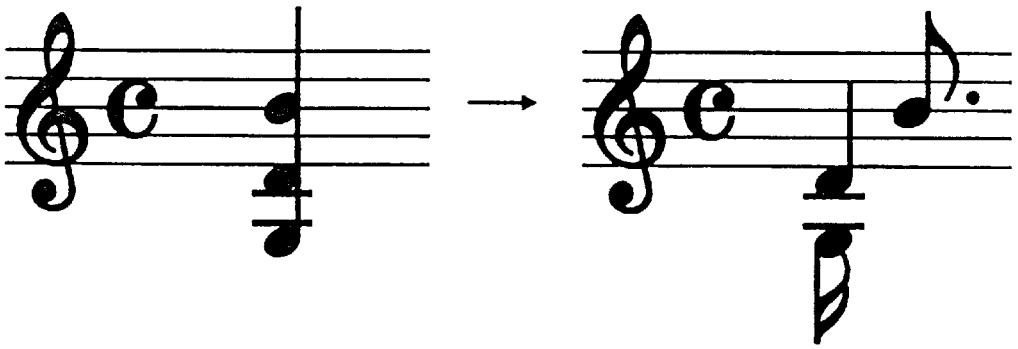
Figure 9:
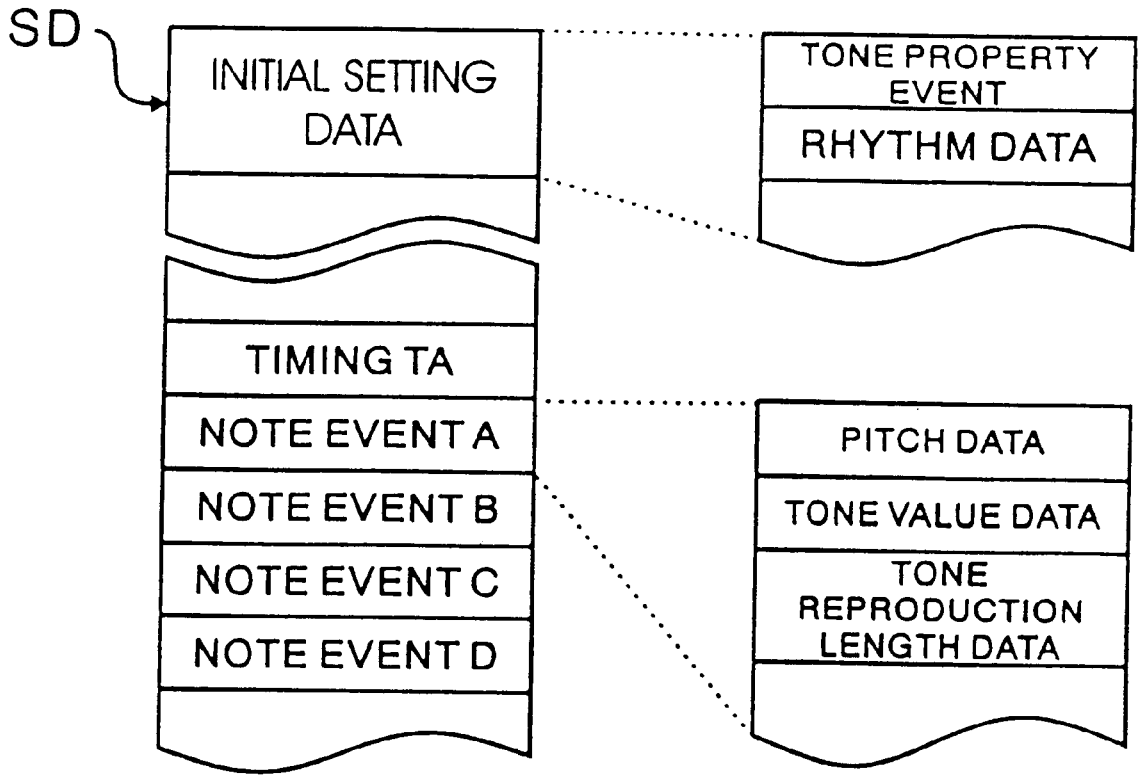
FIG. 9 PRIOR ART
FIG. 9 is a diagram showing the format of performance data according to conventional techniques.

FIGS. 6A and 6B show an example of displayed images before (left side) and after (right side) modification of performance data when a chord of four notes is input. FIG. 6A shows piano roll notation, and FIG. 6B shows a musical score notation. In FIGS. 6A and 6B, although only the portion of performance data to be modified is displayed, the whole of one musical program may be displayed. In this case, it is preferable to highlight the portion to be modified, in order to notify the user of a modified portion.

This score shown on the left side of FIG. 6B cannot be played with a violin because the structure of the violin does not permit to play three strings at the same time. The number of strings capable of being played at the same time is normally two so that the score shown on the left side is required to be played as the score shown on the right side of FIG. 6B.

Therefore, when performance information corresponding to the left side score shown in FIG. 6B is input, it is necessary to change the performance data generated from the input performance information to the performance data corresponding to the right side score shown in FIG. 6B.

FIG. 7A shows performance data SD3 containing a chord of three tones before modification stored in the standard MIDI file format. The performance data SD3 has timing data TA for the reproduction of each tone and note events E to G each including pitch data of each musical tone, tone value data, tone reproduction length data and the like. The performance data SD3 also has a parameter setting event for setting performance environments such as tone properties and effects for a series of consecutive musical tones. The format of the performance data is the same as that of the performance data shown in FIG. 4A.

FIG. 8 shows an example of the data modifying table which stores modified data for a chord of three tones. In this example, a value "41" is stored as the tone property event to be modified. A value "3" is stored as the number of tones of a chord to be modified. It can therefore be understood that the table shown in FIG. 8 is applied to the tone property of violin and the chord of three tones. The note events E to G stand for a lowest sound E, a middle sound F, and a highest sound G.

After the performance data SD3 shown in FIG. 7A is judged to be modified at Step S3 shown in FIG. 2, the following modification is made by referring to the table shown in FIG. 8. For the lowest sound (note event E) in the chord, the sound reproduction timing t2 after modification is set to the same value as the sound reproduction timing t1 before modification (t2=t1). The tone value (v2) after modification is set to a value of the tone value (v1) before modification multiplied by 0.25 (v2=0.25 v1). The tone reproduction length (l2) after modification is set to the same value (l2=0.25 v1) as the tone value (v2) after modification, by multiplying the tone value (v1) before modification by 0.25. After these modifications, the modified data is stored as a tone event e. The reason for setting the tone reproduction length after modification as the same value as the tone value after modification, is to give slur effects.

An actual violin may reproduce three tones at an instant. Therefore, a period of reproducing three tones at the same time may be provided. In this case, it is preferable to modify the value of the tone reproduction length rather than the tone value. More specifically, the tone reproduction length of the lowest sound is longer than the tone value.

For the middle sound (note event C) in the chord, the sound reproduction timing t2 after modification is set to the same value as the sound reproduction timing t1 before modification (t2=t1). The tone value (v2) after modification is set also to the same value as the tone value (v1) before modification (v2=v1). The tone reproduction length (l2) after modification is set also to the same value as the tone reproduction length (l1) before modification (l2=l1). After these modifications, the modified data is stored as a tone event f.

For the highest sound (note event G) in the chord, the sound reproduction timing t2 after modification is a value (0.25 v1+t1) which is an addition of the sound reproduction timing t1 before modification and a tone value (v1) before modification multiplied by 0.25 (0.25 v1). This modification is made so as to delay the sound reproduction timing after modification by a quarter of the tone value before modification. Namely, in order not to reproduce two tones at the same time, the timing is modified relative to the two tones on the lower sound side.

The tone value (v2) after modification is set to the tone value (v1) before modification multiplied by 0.75 (v2=0.75 v1). The tone reproduction length (l2) after modification is set to the same value (l2=0.75 v1) as the tone value (v2) after modification, by multiplying the tone value (v1) before modification by 0.75. After these modifications, the modified data is stored as a tone event g.

FIG. 7B is a diagram showing performance data SD4 after the performance data SD3 shown in FIG. 7A is modified by using the contents in the data modifying table shown in FIG. 8. It can be understood from FIG. 7B that a timing TB is newly inserted to delay the timing of the note event G and reproduce the tone event g at the timing TB. It can also be understood that the tone events E and F are changed to the tone events e and f. In accordance with the modified performance data SD4 or the score data generated from the modified performance data SD4, the display images are changed to the images on the right side of FIGS. 6A and 6B. The modified performance data (FIG. 7B, right side in FIGS. 6A and 6B) of this embodiment can produce a performance like a real violin, such as the middle sound being produced together with both the lowest and highest sounds.

According to the embodiment of the invention, even if a performance unable to be played with a real musical instrument is instructed, the performance data can be automatically modified to reproduce sounds. According to the embodiment, an unnatural portion of performance data actually unable to be played can be automatically changed to performance data which a natural musical instrument can play.

Further, according to the embodiment, performance data generated for a particular musical instrument can be automatically changed to performance data a desired musical instrument can play.

In this embodiment, although the data modifying process uses the data modifying table to obtain modified data, programs or the like may be used to obtain modified data. For example, by using a program, an input chord is divided into groups of two tones, and the reproduction timing of each tone is automatically shifted.

Also in this embodiment, although the tone property and the number of tones of a chord are used for distinguishing between data modifying tables, a musical program tempo and the like may also be used for such distinguishment, or data modifying tables for specific chords may be provided. In this manner, a more natural performance is possible.

Also in this embodiment, although the chords of three and four tones are used by way of example in the description, the data modifying process may also be executed for the chords of two tones and five or more tones. In such cases, each set of two tones may be reproduced at the same time, or a data modifying table for each of the numbers of tones may be prepared.

Also in this embodiment, although the tone property of violin is used, the invention is not limited only to the violin tone property, but the data modifying process may be applied to the tone property of any musical instrument including obviously instruments belonging to a violin group. In this case, the data modifying table for each musical instrument is prepared. One data modifying table may be used for a plurality of musical instruments. A data modifying table for a virtual musical instrument which does not exist in the real world may also be used.

The format of performance data may be any type such as "event+relative time" which uses a lapsed time from the event one event before the present event as the occurrence time of a performance event, "event+absolute time" which uses an absolute time in a program or measure as the occurrence time of a performance event, "pitch (rest)+absolute time" which uses a tone pitch and length or a rest and length for representing performance data, and "direct format" which provides a memory area of each set of performance data in the minimum performance resolution unit and stores the performance data in the memory area corresponding to the occurrence time of the performance event.

The invention may be embodied by installing a program realizing the function of the embodiment in a commercially available general purpose computer, personal computer or the like which runs this program.

In such a case, the program realizing the embodiment function and stored in a computer readable storage medium such as CD-ROM and floppy disc may be supplied to users.

If a general purpose computer, personal computer or the like is connected to a communication network such as a LAN, the Internet and a telephone line, the program and data realizing the embodiment function may be supplied to the general purpose computer, personal computer or the like via the communication network.

The embodiment is not limited only to one apparatus, but it may be applied to a system having a plurality of apparatus connected via communication devices such as MIDI and networks. The embodiment is also applicable to an electronic musical instrument having a tone signal generator, an automatic performance apparatus and the like. The electronic musical instrument may be a keyed instrument type, a stringed instrument type, a wind instrument type, a percussion instrument type, and the like.

The present invention has been described in connection with the preferred embodiments. The invention is not limited only to the above embodiments. It is apparent that various modifications, improvements, combinations, and the like can be made by those skilled in the art.

What we claim are:

1. A data modifying apparatus comprising:

a memory that stores modification data for modifying data;

a judging device that judges whether a tone property of performance data is a specific tone property;

a detector that detects, from performance data, a data group that simultaneously reproduces a plurality of musical tones when said judging device judges the tone property of performance data is the specific tone property; and a modifying device that modifies at least a part of the data group detected by said detector to modify at least a part of reproduction timings of the simultaneously reproduced plurality of musical tones by using the modification data.

2. A data modifying apparatus according to claim 1, wherein said modifying device divides at least a part of the detected data group into a plurality of sub-data groups, and a musical tone corresponding to different sub-data group as a different production timing.

3. A data modifying apparatus according to claim 1, wherein the specific tone property is a tone property corresponding to a musical instrument having a limited ability to produce a plurality of musical tones simultaneously.

4. A data modifying apparatus according to claim 3,wherein the musical instrument belongs to a violin group.

5. A data modifying apparatus comprising:

a judging device that judges whether a tone property of performance data is a specific tone property;

a detector that detects, from the performance data, a portion of performance data that simultaneously reproduces a plurality of musical tones when said judging device judges the tone property of performance data is the specific tone property; and a modifying device that modifies at least a part of the portion of the performance data detected by said detector to modify at least a part of reproduction timings of the simultaneously reproduced plurality of musical tones.

6. A data modifying apparatus according to claim 5, wherein the specific tone property is a tone property of a musical instrument belonging to a violin group.

7. A data modifying apparatus according to claim 5, wherein said modifying device can modify a reproduction time of the part of the portion of the performance data in accordance with the modified reproduction timing.

8. A data modifying apparatus according to claim 5, further comprising;

a memory that stores modification data for modifying data; and a selecting device that selects the modification data in accordance with the number of the plurality of musical tones, wherein said modifying device performs a modification operation in accordance with the modification data selected by said selecting device.

9. A data modifying apparatus according to claim 5, wherein the specific tone property is a tone property corresponding to a musical instrument having a limited ability to produce a plurality of musical tones simultaneously.

10. A data modifying method comprising the steps of:

(a) inputting modification data for modifying data;

(b) judging whether a tone property of performance data is a specific tone property;

(c) detecting, from performance data, a data group that simultaneously reproduces a plurality of musical tones when said judging step (b) judges the tone property of performance data is the specific tone property; and (d) modifying at least a part of the data group detected at said detecting step (c) to modify at least a part of reproduction timings of the simultaneously reproduced plurality of musical tones by using the modification data.

11. A data modifying method comprising the steps of:

(a) judging whether a tone property of performance data is a specific tone property;

(b) detecting, from the performance data, a portion of performance data that simultaneously reproduces a plurality of musical tones when said judging device judges the tone property of performance data is the specific tone property; and (c) modifying at least a part of the portion of the performance data detected at said detecting step (b) to modify at least a part of reproduction timings of the simultaneously reproduced plurality of musical tones.

12. A computer readable storage medium storing a program and modification data for modifying data, the program comprising the steps of:

(a) judging whether a tone property of performance data is a specific tone property;

(b) detecting, from performance data, a data group that simultaneously reproduces a plurality of musical tones when said judging step (a) judges the tone property of performance data is the specific tone property; and (c) modifying at least a part of the data group detected at said detecting step (b) to modify at least a part of reproduction timings of the simultaneously reproduced plurality of musical tones by using the modification data.

13. A computer readable storage medium storing a program comprising the steps of:

(a) judging whether a tone property of performance data is a specific tone property;

(b) detecting, from the performance data, a portion of performance data that simultaneously reproduces a plurality of musical tones when said judging device judges the tone property of performance data is the specific tone property; and (c) modifying at least a part of the portion of the performance data detected at said detecting step (b) to modify at least a part of reproduction timings of the simultaneously reproduced plurality of musical tones.

* * * * *